US005478255A

United States Patent [19]

Hashiguchi

[11] Patent Number: 5,478,255

[45] Date of Patent: Dec. 26, 1995

[54] CONNECTOR ESTABLISHING RELIABLE CONNECTION BY RELATIVE MOVEMENT OF A CONTACT-HOLDING INSULATOR BLOCK AND ITS COVER

[75] Inventor: Osamu Hashiguchi, Tokyo, Japan

[73] Assignee: Japan Aviation Electronics Industry, Limited, Japan

[21] Appl. No.: 252,888

[22] Filed: Jun. 2, 1994

[30] Foreign Application Priority Data

Jun. 3, 1993 [JP] Japan ..... 5-133512

[51] Int. Cl.[6] ..... H01R 4/50

[52] U.S. Cl. ..... 439/342; 439/259

[58] Field of Search ..... 439/259, 266, 439/342, 65, 79, 80, 131, 265, 269, 347

[56] References Cited

U.S. PATENT DOCUMENTS 3,997,231 12/1976 Sherwood ..... 439/264

4,984,383 1/1991 Mummey et al. ..... 439/342 X 5,073,125 12/1991 Hashiguchi et al. ..... 439/259 X 5,354,209 10/1994 Tamura et al. ..... 439/263

*Primary Examiner*—Khiem Nguyen

*Attorney, Agent, or Firm*—Laff, Whitesel, Conte & Saret

[57] ABSTRACT

A connector has an insulator block holding contacts and a cover. The connector connects to a second connector having a housing for removably receiving the cover and having conductors corresponding to the contacts. The insulator block is movable in the cover perpendicular to the direction of contact connection by a manual movement of the cover. At least one elongate slot is formed in either the insulator block or the cover with a slot length equal to a sum of the length of movement and a predetermined length. A protrusion with a length equal to the predetermined length extends from the other of the insulator block or cover, and into the elongate slot. Preferably, an urging leaf spring and a stopper leaf spring are attached to one of the insulator block or cover to be in a lock engagement with the other unless the cover is placed in the housing.

10 Claims, 9 Drawing Sheets

CONNECTOR ESTABLISHING RELIABLE CONNECTION BY RELATIVE MOVEMENT OF A CONTACT-HOLDING INSULATOR BLOCK AND ITS COVER

BACKGROUND OF THE INVENTION

This invention relates to a connector which establishes electric connection as a first connector to a second connector by a relative movement caused between a contact-holding insulator block of the first connector and a cover for the insulator block by a manual movement of the cover in a predetermined direction of connection of the first and the second connectors perpendicularly of the predetermined direction.

Connectors of this type are already known. In the manner which will later become clear with regard to a conventional connector of the type described, one and the other of the insulator block and the cover of the first connector are provided with an elongate slot and a protrusion which has a circular cylindrical shape and is slidably movable in the elongate slot. The insulator block rigidly holds a plurality of electric contacts. The second connector comprises a housing for removably receiving the cover of the first connector in the predetermined direction and a plurality of electric conductors within the housing in one-to-one correspondence to the electric contacts.

When it is desired to connect the first connector to the second connector, the cover is held by hand and is pushed into the housing. This manual movement of the cover causes the insulator block to move the electric contacts towards the electric conductors and to establish an electric connection between the electric contacts and the electric conductors.

In order so to cause the relative movement, the elongate slot is formed with a small angle formed relative to the predetermined direction. Merely for brevity of the description, it will be presumed for the time being that the elongate slot is formed in the cover with the protrusion protruded outwardly from the insulator block. Usually, the cover is provided with two elongate slots along each inner face of the cover and consequently four elongate slots in total. Accordingly, the insulator block has four protrusions.

Despite this number of pairs of the elongate slots and the protrusions, the insulator block is unavoidably subjected to a rotational movement within the cover. This is particularly the case while the cover is pushed into and pulled out of the housing. Such a rotational movement makes it impossible to connect the first connector to the second connector. Even if it were possible to establish the electric connection, the electric contacts and/or the electric conductors may be damaged. The electric contacts and/or the electric conductors are liable to damages also on disconnecting the first connector from the second connector with the electric connection disestablished.

Furthermore, the relative movement is appreciably free. As a consequence, the insulator block is too much readily movable between a first and a second position at which the electric contacts are brought out of and into electric connection from and to the electric conductors. If the insulator block is put in the second position before the first connector is brought into touch with the second connector, it is next to impossible to connect the first connector to the second connector. The cover must therefore be pushed into the housing with the insulator block kept additionally by hand in the first position and with the hand left from the insulator block when the cover is placed in position in the housing.

This is troublesome.

The relative movement may furthermore result in pull of the cover out of the housing with an objectionable angle formed between the predetermined direction and a direction of pull. This gives rise to application of an unnatural force to the electric contacts before the electric contacts are disengaged from the electric conductors.

In order to obviate the trouble experienced on connecting the first connector to the second connector and the unnatural force applied to the electric contacts on disconnecting the first connector from the second connector, a seemingly improved connector has been proposed with a coil spring used to urge the insulator block towards the first position within the cover. In this event, a mechanism is indispensable to force the insulator block towards the second position when the cover is positioned almost in place within the housing. This necessitates a complicated design.

The cover is often pushed into the housing obliquely relative to the predetermined direction. Connection of the first connector to the second connector is again impossible. The electric contacts and/or the electric conductors may be damaged.

The cover may intentionally or unintentionally be moved relative to the insulator block in a direction of push to place the insulator block in the second position while the first connector is left alone without being connected to the second connector. In such an event, it is impossible to connect the first connector actually to the second connector. The electric contacts and/or the electric conductors may again be damaged.

SUMMARY OF THE INVENTION

It is consequently a principal object of the present invention to provide a connector which comprises an insulator block rigidly holding a plurality of electric contacts and a cover covering the insulator block and is capable of establishing a reliable connection as a first connector in a predetermined direction of connection to a second connector comprising a housing for removably receiving the cover and a plurality of electric conductors in one-to-one correspondence to the electric contacts with the electric contacts reliably brought into connection to the electric conductors.

It is another principal object of this invention to provide a connector which is of the type described and which can be connected to the second connector without fail.

It is still another principal object of this invention to provide a connector which is of the type described and which can reliably be disconnected from the second connector.

It is yet another principal object of this invention to provide a connector which is of the type described and which does not damage the electric contacts and/or the electric conductors on connecting and disconnecting the first connector to and from the second connector.

It is a further principal object of this invention to provide a connector which is of the type described and which can be connected to the second connector with no trouble of additionally touching the insulator block on connecting the first connector to the second connector.

It is a still further principal object of this invention to provide a connector which is of the type described and which can be disconnected from the second connector with no unnatural force applied to the electric contacts and/or the electric conductor.

It is a yet further principal object of this invention to provide a connector which is of the type described and which is simple in structure.

It is a subordinate object of this invention to provide a connector which is of the type described and which can be connected to the second connector with the insulator block prevented from being obliquely positioned relative to the predetermined direction within the cover.

It is another subordinate object of this invention to provide a connector which is of the type described and in which the insulator block is moved substantially in the predetermined direction in addition to the relative movement perpendicular to the predetermined direction between a first and a second position at which the insulator block is eventually placed relative to the cover while the first connector is disconnected and connected from and to the second connector, respectively.

It is still another subordinate object of this invention to provide a connector which is of the type described and which can correct a direction of push into the housing of the cover together with the insulator block if the direction of push is only a little different from the predetermined direction.

It is yet another subordinate object of this invention to provide a connector which is of the type described and which can prevent the insulator block from moving both parallel and perpendicular to the predetermined direction unless the cover is positioned in the housing.

Other objects of this invention will become clear as the description proceeds.

On setting forth the gist of this invention, it is possible to understand that a connector is for connection as a first connector to a second connector with the first and the second connectors disposed in a predetermined direction and comprises an insulator block rigidly holding a plurality of electric contacts parallel to the predetermined direction and a cover covering the insulator block and being movable in the predetermined direction by a length of movement. In the connector understood as above, one and the other of the insulator block and the cover are provided with an elongate slot with a predetermined angle formed relative to the predetermined direction and a protrusion movable in the elongate slot when the cover is moved in the predetermined direction.

In accordance with this invention, the elongate slot of the above-understood connector is given in the predetermined direction a slot length which is longer than a sum of the length of the movement and a predetermined length. The protrusion of the above-understood connector is given a protrusion length which is equal to the predetermined length.

Preferably, the predetermined length is about the length of movement long. In other words, the slot length should be about twice as long as that of a conventional connector of the type described. The predetermined angle is very preferably less than 45° of angle.

DESCRIPTION OF THE PREFERRED EMBODIMENTS

Figure 1:
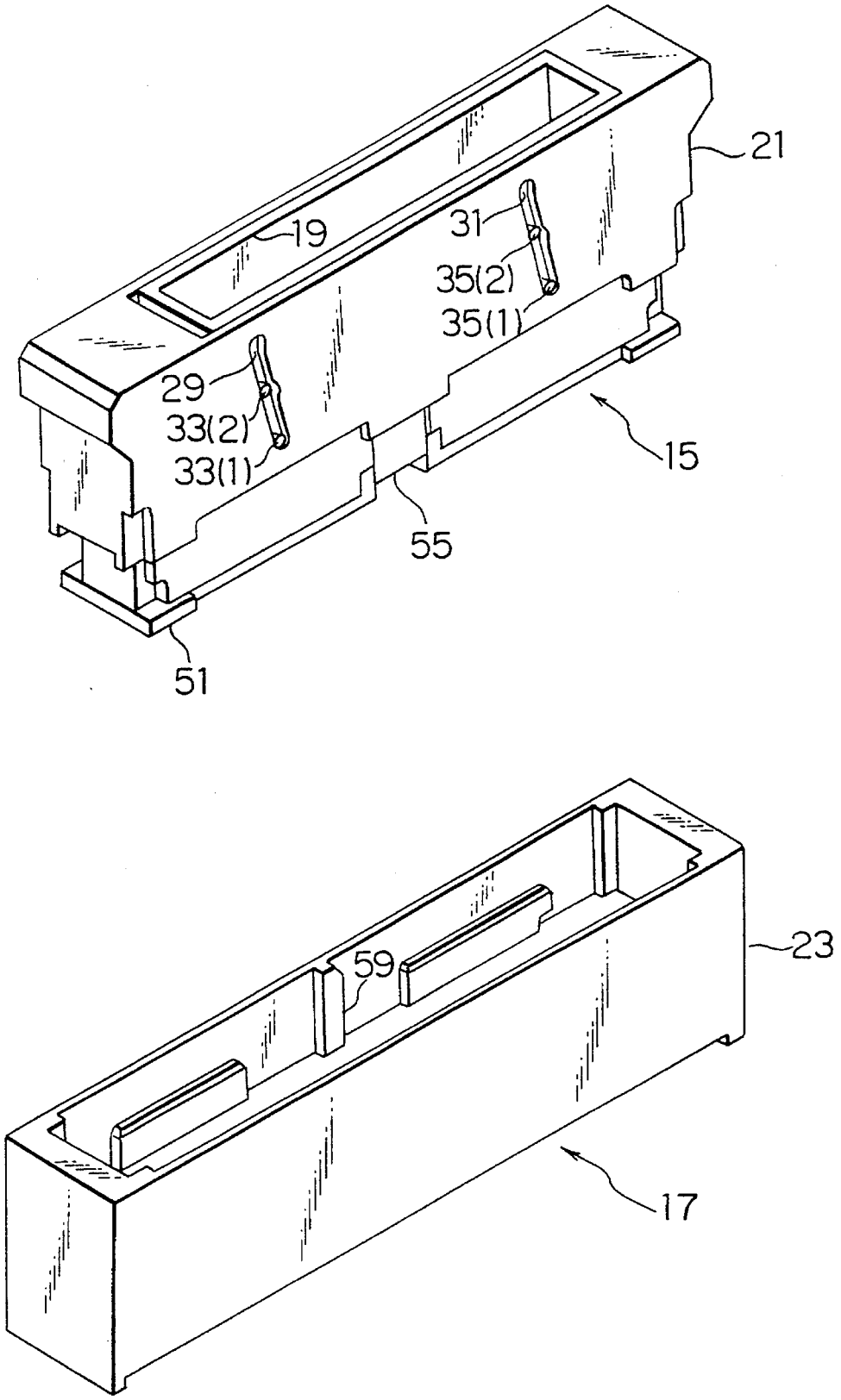
FIG. 1 is a schematic perspective view of a connector according to a first embodiment of the instant invention and of a counterpart connector which are referred to herein as first and second connectors.

Referring to FIG. 1, a connector is used as a first connector 15 for connection to a second connector 17 in a predetermined direction of connection. The predetermined direction is a top-bottom direction in the figure.

Similar to a conventional connector of the type being illustrated, the first connector 15 comprises an insulator block 19 and a cover 21 covering the insulator block 19. The second connector 17 comprises a housing 23 for removably receiving the cover 21. In the manner which will presently be illustrated, the insulator block 19 rigidly holds a plurality of electric contacts 25. In one-to-one correspondence to the electric contacts 25, a plurality of electric conductors 27 are rigidly held by the housing 23.

When it is desired to connect the first connector 15 to the second connector 17, the cover 21 is held by hand and is pushed into the housing 23 in a direction of push which should be parallel to the predetermined direction. Electric connection is established between the electric contacts 25 and the electric conductors 27. When it is desired to disconnect the first connector 15 from the second connector 17, the cover 21 is pulled by hand out of the housing 23 in a direction of pull which should be parallel to the predetermined direction. The electric connection is disestablished.

Figure 2:
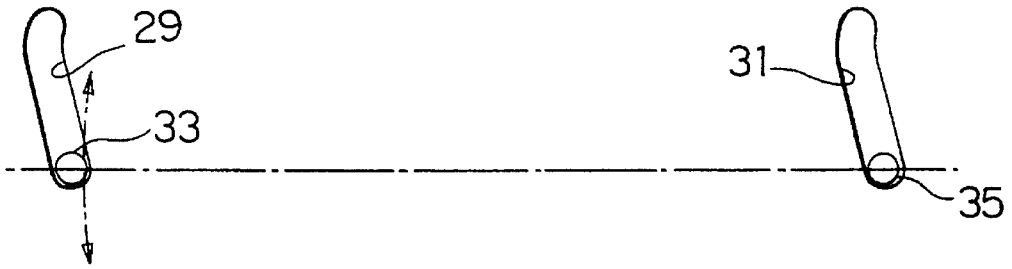
PRIOR ART FIG. 2
FIG. 2 shows in conjunction with a conventional connector a front view of two elongate slots and a protrusion movable in each of the elongate slots.

Turning to FIG. 2 with FIG. 1 continuously referred to, left and right elongate holes 29 and 31 are formed in one of the insulator block 19 and the cover 21 with a predetermined angle formed between the predetermined direction and each of the elongate slots 29 and 31. The predetermined angle is small. It will be presumed merely for brevity of the description that the elongate slots 29 and 31 are formed in the cover 21 along one inner face of the cover 21. In this event, left and right circular cylindrical protrusions 33 and 35 are fixed to the insulator block 19 so as to be slidably movable in the elongate slots 29 and 31. Although not seen in the figure, like elongate slots are formed in the cover 21 along an opposite inner face. Like protrusions are fixed to the insulator block 19 so as to be slidably movable in these elongate slots. Such elongate holes should be parallel to the elongate slots 29 and 31.

These four pairs of the elongate slots, such as 29 and 31, and the protrusions, such as 33 and 35, are similarly operable. Attention will consequently be directed only to the protrusions 33 and 35 and to the elongate slots 29 and 31.

Inasmuch as the elongate slots 29 and 31 are directed obliquely relative to the predetermined direction, push of the cover 21 into the housing 23 in the direction of push moves the insulator block 19 mainly perpendicular to the predetermined direction to eventually establish the electric connection. In FIG. 1, the insulator block 19 therefore has a left-side end a little spaced from a left-side wall of the cover 21 while the first connector 15 is either left alone or before connection to the second connector 17. It will be noted in FIG. 2 that each of the elongate slots 29 and 31 has an upper end portion which forms a smaller angle with the predetermined direction. This is in order to firmly establish the electric connection. The predetermined and the smaller angles are empirically decided.

When the cover 21 is pushed into the housing 23, the cover 21 moves the insulator block 19 from a first position to a second position. At the first and the second positions, the first connector 15 is disconnected from and is connected to the second connector 17, respectively, with the electric connection disestablished and established. Meanwhile, the cover 21 is moved by a length of movement relative to the insulator block 19. It is possible without loss of generality to understand that the length of movement is measured in the predetermined direction.

It should be noted here that the elongate slots 29 and 31 and the protrusions 33 and 35 are manufactured with a certain error of manufacture taken into consideration. In other words, the protrusions 33 and 35 fit the elongate slots 29 and 31 with a certain clearance. Due to the clearance, the cover 21 is undesiredly subjected to a rotational movement relative to the insulator block as exemplified by an arrowhead arcuate line while given the length of movement. This unavoidably gives rise to a swing of the left protrusion 33 along a dash-dot-line circular arc having its center at the right protrusion 35 and results in incapability of connection and disconnection of the first connector 15 to and from the second connector 17, in damages to the electric contacts 25 and/or to the electric conductors 27, and in troublesome handing of the insulator block 19 in the manner pointed out hereinabove.

Referring afresh to FIG. 3 and again to FIG. 1, the first connector 15 is manufactured in accordance with a first embodiment of the present invention. In the manner presumed in the foregoing, left and right elongate holes are formed in the cover 21. Although formed parallel to a straight line and given a common slot length which is different from that given to the elongate slots 29 and 31 described in conjunction with FIG. 2 and will shortly be described, the elongate slots of FIG. 3 will be designated by the reference numerals 29 and 31. First and second left protrusion elements 33(1) and 33(2) and first and second right protrusion elements 35(1) and 35(2) are fixed to the insulator block 19. Each combination of the left protrusion elements 33 (suffixes omitted) and of the right protrusions 35 (suffixes omitted) is collectively referred to depending on the circumstances as a protrusion. Each of the protrusion elements 33 and 35 has a circular cylindrical shape.

The slot length is equal to a sum of the length of movement and a predetermined length. Left and right combinations of the protrusion elements 33 and 35 have a common protrusion length which is equal to the predetermined length. In the manner depicted in FIG. 3, the predetermined length is substantially equal to the length of movement if measured in the predetermined direction. It should be noted in this connection that the expression "protrusion length" does not mean a length of protrusion of each of the left and the right protrusions 33 and 35 as measured perpendicularly from a surface of an outer surface of the insulator block 19 but is a measure of the length of the left or the right protrusion 33 or 35 taken parallel to the outer surface of block 19.

When only the first left protrusion element 33(1) is taken into account, the cover 21 would be subjected to the rotational movement described in connection with FIG. 2. The rotational movement has its center at the first right protrusion element 35(1). The fact is, however, that the second left protrusion element 33(2) is used in addition to the first left protrusion element 33(1) slidably movable in the left elongate slot 29 together with the first left protrusion element 33(1). Defined by the second left protrusion element 33(2) and the first right protrusion element 35(1), a straight line intersects with the left elongate slot 29 with an angle θ shifted. The rotational movement is therefore astonishingly restricted.

This enables a translation of the insulator block 19 relative to the cover 21 to attain a reliable connection and disconnection of the first connector 15 to and from the second connector 17 and to establish a reliable electric connection and disconnection of the electric contacts 25 to and from the electric conductors 27. As a consequence, damages to the electric contacts 25 and/or the electric conductors 27 are avoided. Furthermore, this obviates necessity of additionally touching the insulator block 19 by hand on connecting the first connector 15 to the second connector 17 and undesirable application of an unnatural force to the electric contacts 25 and/or the electric conductors 27 on disconnecting the first connector 15 from the second connector 27. Addition of the second left and right protrusion elements 33(2) and 35(2) to the first left and right protrusion elements 33(1) and 35(1) does not much complicate the first connector 15 in structure.

Figure 3:
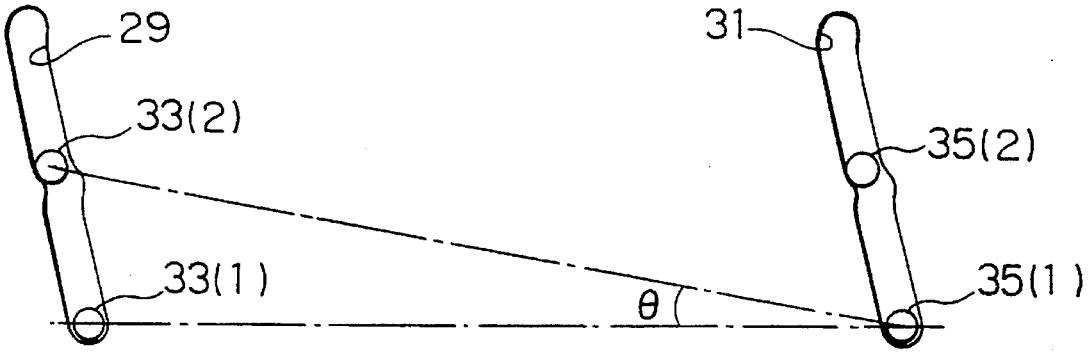
FIG. 3 is a front view of left and right elongate slots and left and right protrusions used in the first connector depicted in FIG. 1.
Figure 4:
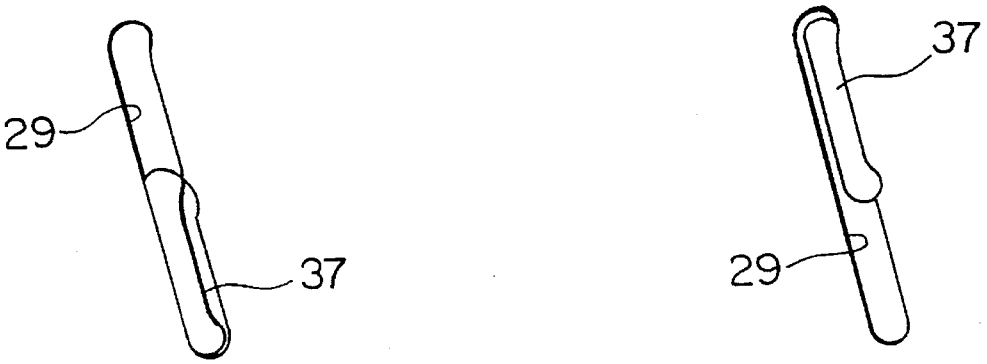
FIG. 4 shows in two states a front view of an elongate slot and a modified protrusion.

Turning to FIG. 4 with FIG. 1 continuously referred to, left and right elongate protrusions 37 and 39 (later illustrated) are substituted for the left and the right combinations of protrusion elements 33 and 35 described in conjunction with FIG. 3. Each of the left and the right elongate protrusions 37 and 39 is given the protrusion length of the predetermined length. It will readily be understood that the first connector 15 with the elongate protrusions 37 and 39 is given salient features described with reference to FIGS. 1 and 3.

In FIG. 4, a pair of the left elongate slot 29 and the left elongate protrusion 37 alone is illustrated assuming that the insulator block 19 (FIG. 1) is put in the first position. On the right side of the figure, the pair is depicted with an assumption such that the insulator block 19 is put in the second position.

Figure 5:
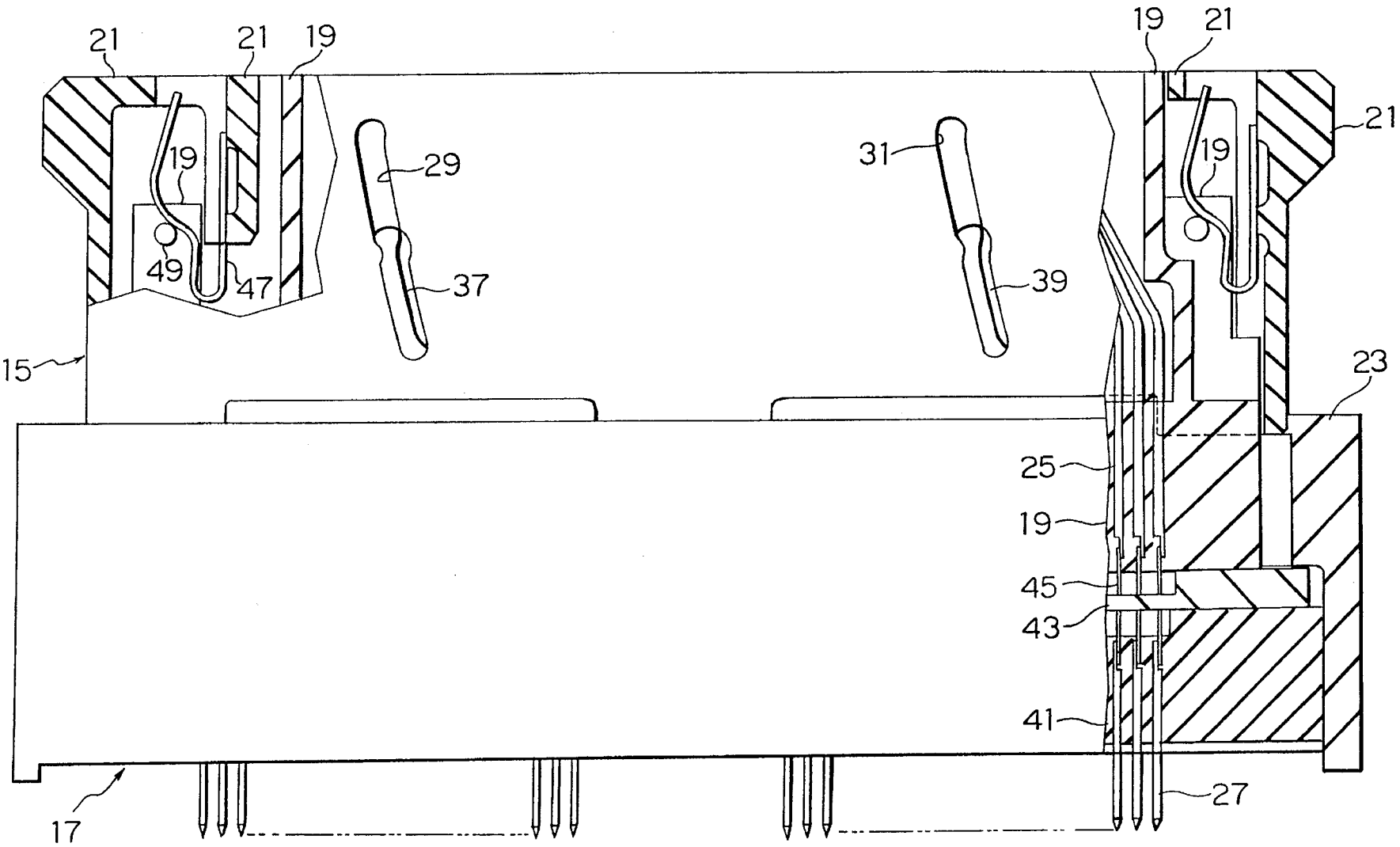
FIG. 5 is a schematic vertical sectional view of the first and the second connectors which are brought into mechanical touch with each other.

Referring now to FIG. 5, the first and the second connectors 15 and 17 are depicted in mechanical touch with each other. The cover 21 is not yet actually pushed into the housing 23 together with the insulator block 19. As a result, the insulator block 19 is left in the first position. The electric connection is not yet established between the electric contacts 25 and the electric conductors 27.

In the example being illustrated, the housing 23 supports a first insulator member 41 rigidly holding the electric conductors 27 and a second insulator member 43 which is slidable on the first insulator member 41 and rigidly carries a plurality of intermediate contacts 45 in one-to-one correspondence to the electric conductors 27 and consequently to the electric contacts 25. Extended perpendicularly through the second insulator member 43, the intermediate contacts 45 are deformable at least in a direction of movement of the insulator block 19 between the first and the second positions. The intermediate contacts 45 (FIG. 5) are not yet in complete touch with full contact pressure against the electric contacts 25, but contacts 45 are always in electric connection with the electric conductors 27.

Figure 6:
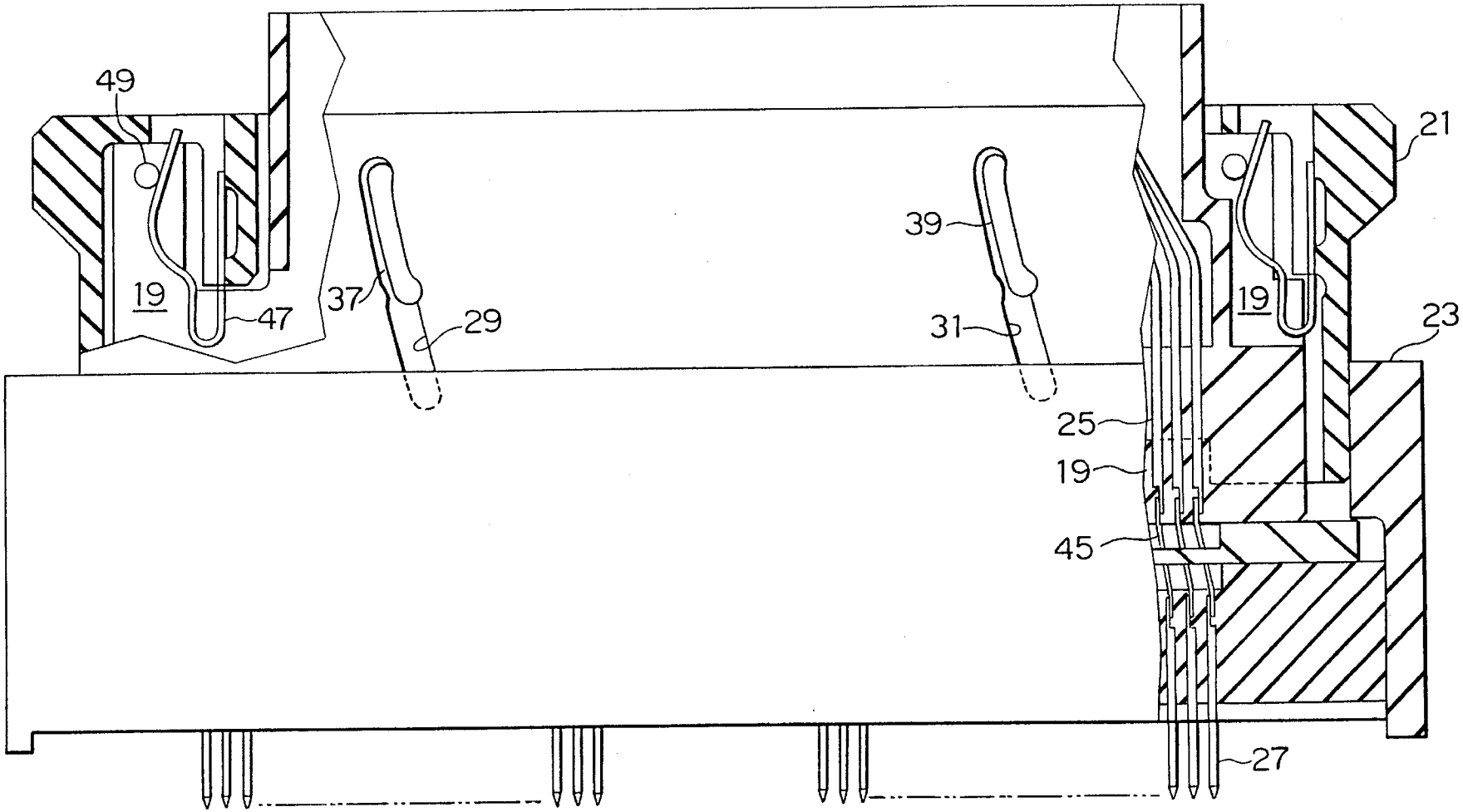
FIG. 6 is a schematic vertical sectional view of the first and the second connectors connected to each other.

Turning to FIG. 6, the cover 21 is pushed into the housing 23 up to the length of movement relative to the insulator block 19. This moves the insulator block 19 from the first position to the second position. The intermediate contacts 45 are deformed to be fully brought into electric connection with full contact pressure against the electric contacts 25. The first connector 15 is connected to the second connector 17 to establish the electric connection between the electric contacts 25 and the electric conductors 27.

Referring more particularly to FIGS. 5 and 6, the cover 21 preferably comprises an urging leaf spring 47 having an end fixed to the left-side wall of the cover 21 and a free end. Between these ends, the urging leaf spring 47 has an arcuately protruded portion protruded into a void formed in the left-side wall of the cover 21. To be slidable along the urging leaf spring 47, an urging member 49 is fixed to a leftward and topward extension of the insulator block 19 and urges the insulator block 19 towards the first position when the insulator block 19 is put in the first position. In this case, the urging member 49 is placed below the protruded portion and urges the insulator block 19 rightwards and topwards. While the cover 21 is pushed in the direction of push relative to the insulator block 19, the urging member 49 slides up to the protruded portion and urges the insulator block 19 still towards the first position. When the cover 21 is eventually pushed relative to the insulator block 19 by the length of movement, the urging member 49 slides along the urging leaf spring 47 to its free end. At this instant, the insulator block 19 is urged rightwards and bottomwards towards the second position.

It is possible to fix the urging leaf spring 47 to the insulator block 19 and the urging member 49 to the cover 21. In order to insure translation of the insulator block 19 relative to the cover 21 while the first connector 15 is either connected to the second connector 17 or while the first connector 15 is disconnected from the second connector 17, a like combination of the urging leaf spring and the urging member is used also at the right ends of the insulator block 19 and the cover 21.

Figure 7:
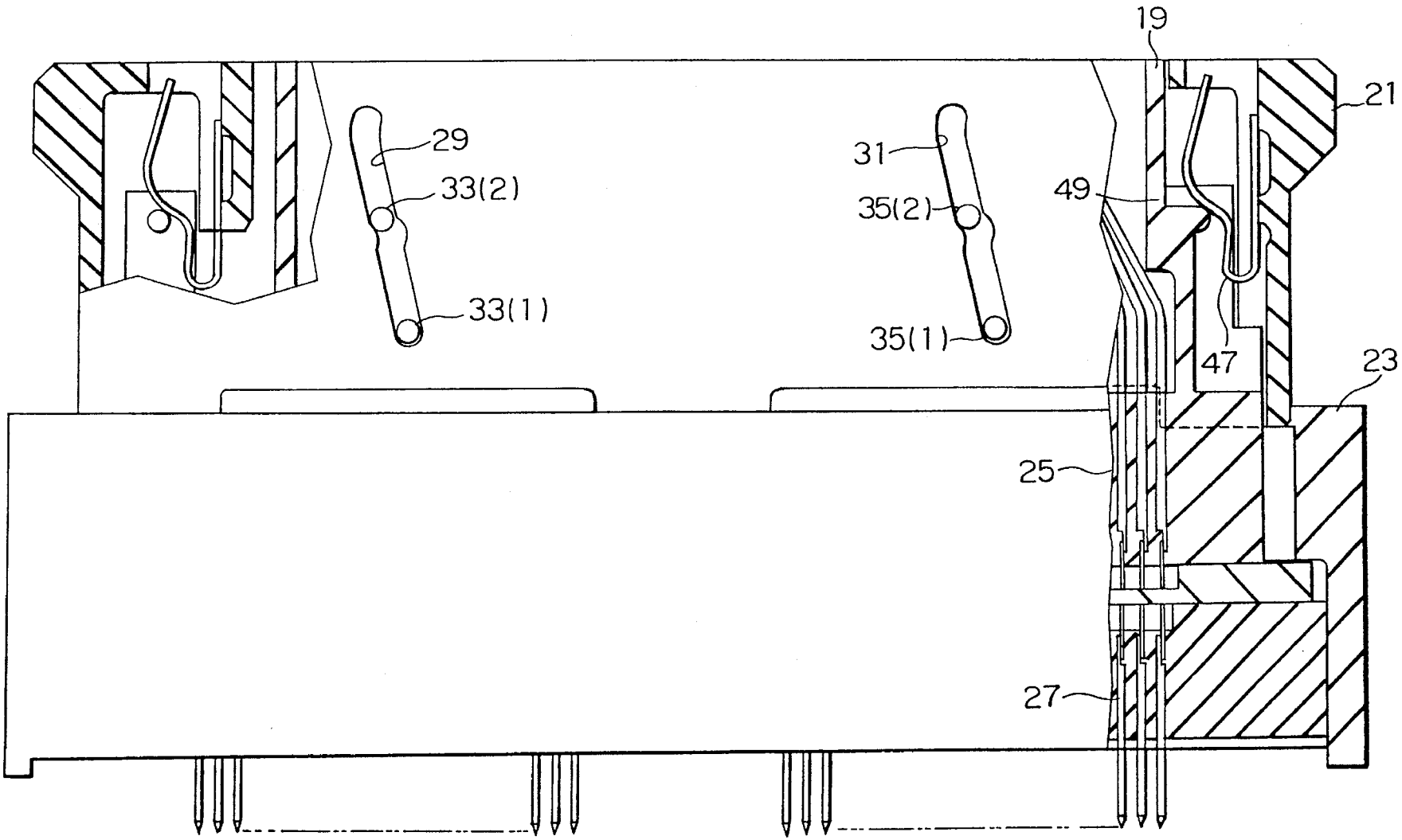
FIG. 7 shows schematic vertical sectional views of a first modified connector and of the second connector with the first modified and the second connectors brought into mechanical touch with each other.
Figure 8:
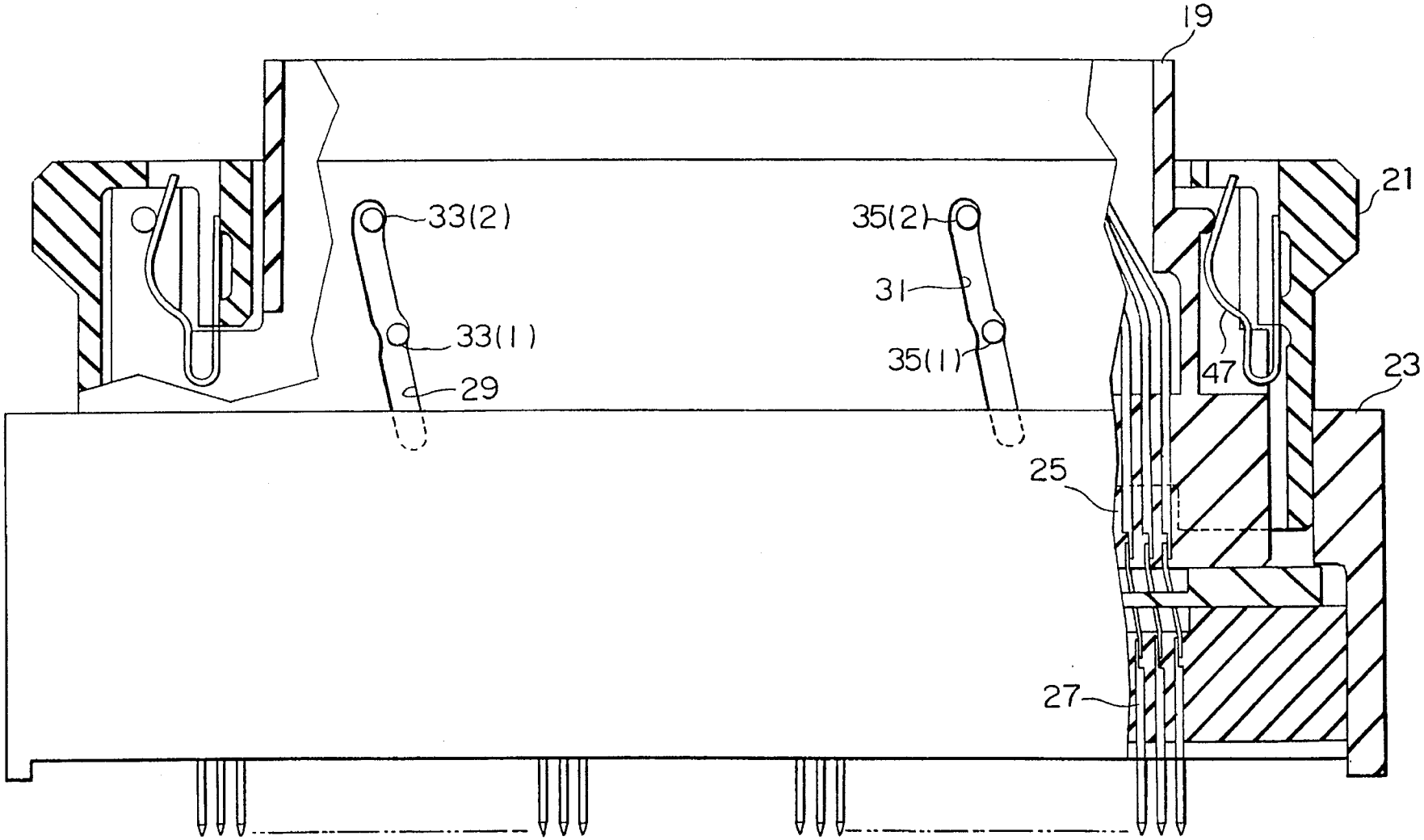
FIG. 8 is a schematic vertical sectional view of the first modified connector and of the second connector which are connected to each other.

Further turning to FIGS. 7 and 8, each of the urging members, such as 49, may be given a modified shape in the manner exemplified on the right side at 49. In FIGS. 5 through 8, it is appreciated that the first connector 15 has an additional feature such that the insulator block 19 is prevented from being obliquely positioned relative to the cover 21 while the first connector 15 is connected and disconnected to and from the second connector 17. Furthermore, the insulator block 19 is moved substantially in the predetermined direction in addition to the relative movement perpendicular to the predetermined direction between the first and the second positions while the first connector 15 is connected and disconnected to and from the second connector 17. This unnecessitates a locking mechanism for locking the insulator block 19 in the second position while the first connector 15 is kept connected to the second connector 17.

Figure 9:
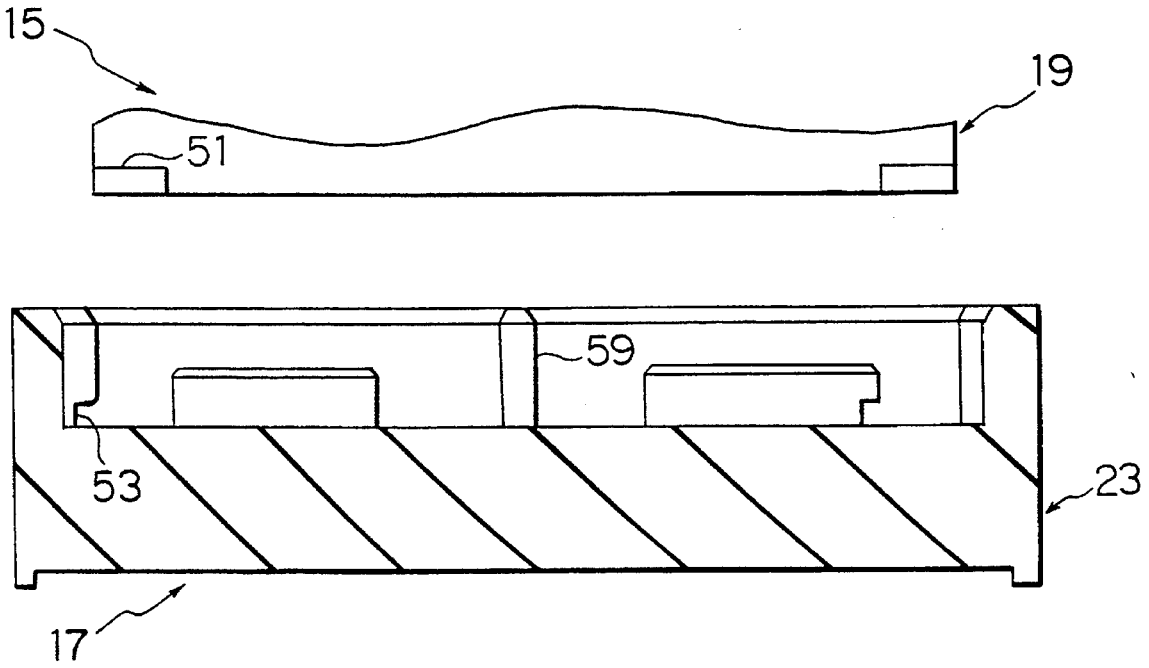
FIG. 9 schematically shows a partial side view of a first connector and a partially broken away side view of a second connector which are according to a second embodiment of this invention and are disconnected from each other.
Figure 10:
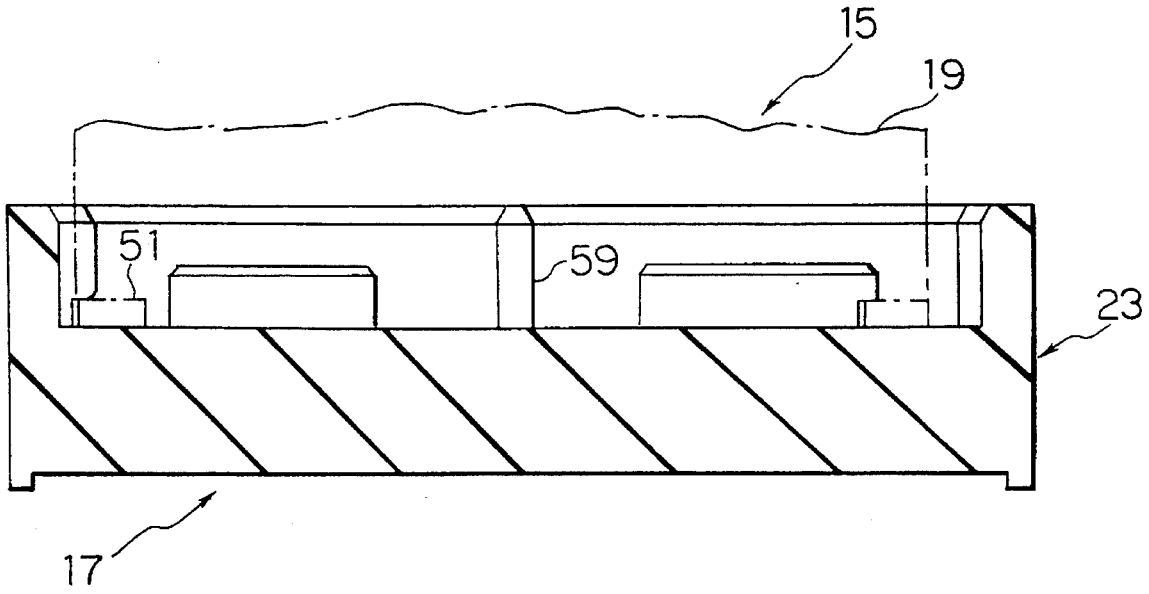
FIG. 10 schematically shows a partially cut away side view of the second connector and, with imaginary lines, a partial side view of the first connector, which first and second connectors are those depicted in FIG. 9 and are connected to each other.

Referring anew to FIGS. 9 and 10 and once more to FIG. 1, the description will proceed to first and second connectors 15 and 17 according to a second embodiment of this invention. These first and second connectors 15 and 17 are not different from those illustrated with reference to FIGS. 1 and 3 through 8 except for the following.

In the first connector 15, the insulator block 19 comprises a side projection 51 of a rectangular prism shape protruded therefrom near a left-side end perpendicular to the predetermined direction and to the direction of movement between the first and the second positions substantially to an outer face of the cover 21. In the second connector 17, the housing 23 is capable of receiving the side projection 51 and comprises an engaging member 53 by which the side projection 51 passes and which engages the side projection 51 while the cover 21 is moved into and out of the housing 23 together with the insulator block 19 kept in the first position as in FIG. 9 and when the insulator block 19 is put eventually in the second position as in FIG. 10, respectively.

In FIGS. 9 and 10, the side projection 51 has a bevelled side projection end surface directed to the second position when the cover 21 is positioned in the housing 23 together with the insulator block 19. The engaging member 51 comprises a top projection protruded towards the first position and having a bevelled top end surface directed to the first position when the cover 21 is placed in the housing 23 together with the side projection 51.

A combination of the side projection 51 and the engaging member 53 prevents push of the cover 21 and the insulator block 19 into the housing 23 when the insulator block 19 is erroneously directed away from the predetermined direction. The combination makes it possible to correctly position the insulator block 19 in the housing 23 when the first connector 15 is connected to the second connector 17. The bevelled side and top projection end surfaces facilitate correct positioning of the insulator block 19 in the housing 23. For this purpose, it is preferred to use the last-mentioned combination at four corners of the insulator block 19 and of the housing 23 and additionally to form four grooves (not shown) along the inner faces of the housing 23 to guide the four side projections, such as 51 with these projections a little protruded from the outer faces of the cover 21, while the insulator block 19 is moved into and out of the housing 23.

Figure 11:
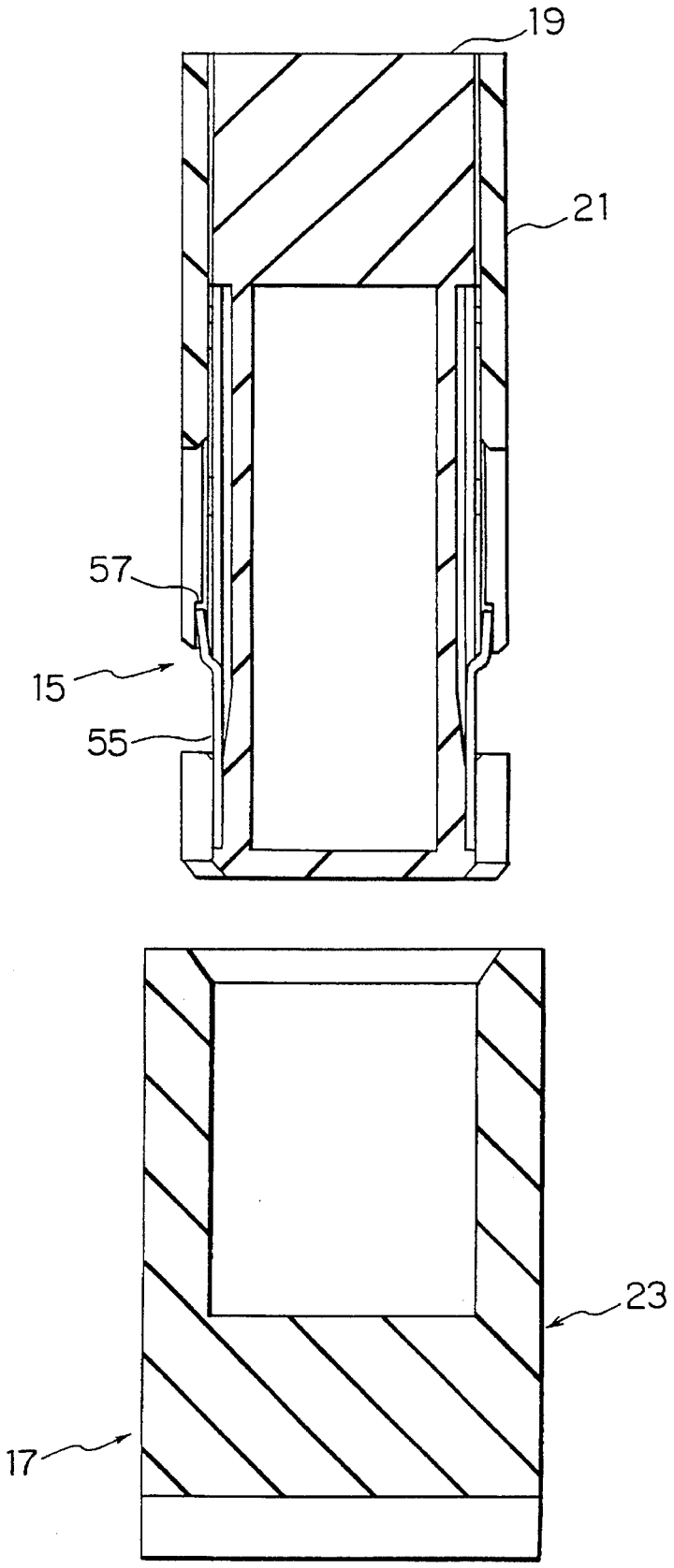
FIG. 11 schematically shows in vertical section of the first and the second connectors put in a disconnected state with the vertical section taken perpendicularly of that depicted in each of FIGS. 5 through 10.
Figure 12:
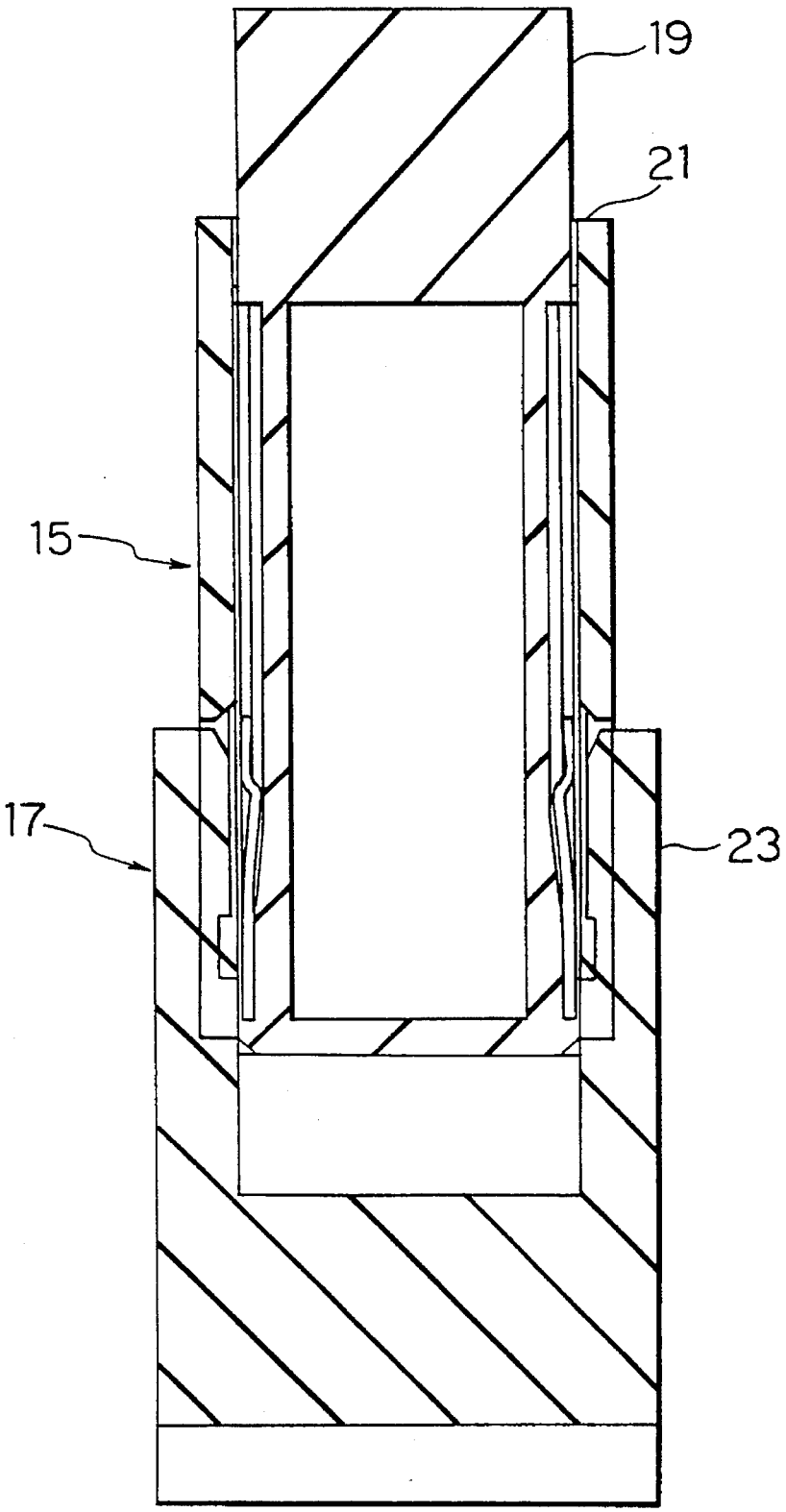
FIG. 12 schematically shows vertical sectional views of the first and the second connectors depicted in FIG. 11 and connected to each other.

Turning to FIGS. 11 and 12 with additional reference to FIG. 1, the insulator block 19 preferably comprises a stopper leaf spring 55 having one end fixed thereto and a free end. The cover 21 comprises a stopping member 57 which establishes a lock engaging contact with the free end while the stopper leaf spring 55 is left free. The housing 23 comprises a pressing or releasing member 59 for pressing the stopper leaf spring 55 to release the lock engaging contact and to enable the insulator block 19 to move relative to the cover 21 when the cover 21 is placed in the housing 23 together with the insulator block 19 and with the stopper leaf spring 55. It is desirable for ease of manufacture of the first and the second connectors 15 and 17 and for reliable operation to provide the stopper leaf spring 55 and consequently the stopping and the pressing members 57 and 59 midway between the left-side and the right-side ends on each face of the insulator block 19 and along each face of the cover 21 and therefore on each inner face of the housing 23.

In the example being illustrated, the stopper leaf spring 55 is fixed to the insulator block 19 at its bottom end. The free end is upwardly extended parallel to the predetermined direction with a protruded bent portion bent away from the insulator block 19. The cover 21 has a downward projection on each face. In the downward projection, a stepped portion provides the stopping member 57. The pressing member 59 presses the protruded bent portion against a spring action of the stopper leaf spring 55.

In cooperation with the stopping member 57, the stopping leaf spring 55 prevents the insulator block 19 from moving relative to the cover 21 parallel to the predetermined direction and consequently perpendicular to the predetermined direction while the first connector 15 is left alone without connected to the second connector 17. As a result, the insulator block 19 is never dispositioned relative to the cover 21 to undesiredly prevent push of the cover 21 into the housing 23 even if the first and the second connectors 15 and 17 comprise the side protrusions, such as 51, and the engaging members, such as 53. When the cover 21 is pushed into the housing 23 together with the insulator block 19 and the stopping leaf spring 55, the pressing member 59 releases the lock engaging contact to establish correct electric connection between the electric contacts 25 and the electric conductors 27. Inasmuch as the first connector 15 is correctly connected to the second connector 17, no unnatural force is applied to the electric contacts 25 and/or to the electric conductors 27 while the first connector 15 is disconnected from the second connector 27. The electric contacts 25 and/or the electric conductors 27 are never damaged.

In FIGS. 11 and 12, not illustrated merely for simplicity are the electric contacts 25, the electric conductors 27, and the intermediate contacts 45 described in conjunction with FIGS. 5 through 8. The insulator block 19 has a bottom wall. The electric contacts 25 are rigidly fixed to the bottom wall.

Reviewing FIGS. 11 and 12, it is possible to define the pressing member 59 without mentioning to the housing 23. That is, it is possible to understand that the second connector 17 comprises the pressing member 59. In this event, the pressing member 59 releases the lock engaging contact to enable the insulator block 19 to move relative to the cover 21 when the first connector 15 is connected to the second connector 17 with the stopper leaf spring 55 brought into contact with the pressing member 59.

While this invention has thus far been described in specific connection with two preferred embodiments thereof and a few preferred modifications, it will now be readily possible for one skilled in the art to put this invention into practice in various other manners. For example, the housing 23 need not comprise the intermediate contacts 45 but may merely rigidly hold the electric conductors 27 therein. Above all, the first connector 15 may comprise only two pairs of the elongate slots 29 and 31 and either the combinations of the protrusion elements 33 and 35 or the elongate protrusions 37 and 39. In this event, the elongate slots 29 and 31 may be formed either on one face alone or on both faces of the insulator block 19 with the elongate slots 29 and 31 spaced apart by a predetermined spacing from each other. It is furthermore possible to form only one pair of the elongate slot 29 and either the combination of the protrusion elements 33 or the elongate protrusion 37 either along only one face of the insulator block 19 or along only one inner face of the cover 21.

What is claimed is:

1. A connector for completing a connection from a first connector to a second connector with said first and said second connectors disposed in a predetermined direction, said first connector comprising an insulator block rigidly holding a plurality of electric contacts parallel to said predetermined direction and a cover covering said insulator block, said cover being movable in said predetermined direction by a distance equal to a length of a desired cover-to-block movement, one of said insulator block and said cover having an elongate slot which is inclined at a predetermined angle relative to said predetermined direction and a protrusion on the other of said insulating block and said cover, said protrusion being movable in said elongate slot when said cover is moved in said predetermined direction, wherein:

said elongate slot has a slot length in said predetermined direction which is at least twice said length of movement; and said protrusion has a length in said predetermined direction which is substantially equal to said length of movement.

2. A connector as claimed in claim 1, wherein said predetermined angle is less than 45°.

3. A connector as claimed in claim 1, said elongate hole and said protrusion being a first elongate hole and a first projection, wherein:

one of said insulator block and said cover is provided with a second elongate hole with said predetermined angle formed between said predetermined direction and said second elongate hole, with said hole length given in said predetermined direction, and with a predetermined spacing left from one of said first elongate hole and said first protrusion that is formed in said one of insulator block and cover;

the other of said insulator block and said cover being provided with a second protrusion with said protrusion length given in said predetermined direction to be movable in said second elongate hole when said cover is moved in said predetermined direction.

4. A connector for completing a connection from a first connector to a second connector with said first and said second connectors disposed in a predetermined direction, said first connector comprising an insulator block rigidly holding a plurality of electric contacts parallel to said predetermined direction and a cover covering said insulator block, said cover being movable in said predetermined direction by a distance equal to a length of a desired cover-to-block movement, one of said insulator block and said cover having an elongate slot which is inclined at a predetermined angle relative to said predetermined direction and a protrusion on the other of said block and said cover, said protrusion being movable in said elongate slot when said cover is moved in said predetermined direction, wherein:

said elongate slot having a slot length in said predetermined direction which is at least twice said length of movement;

said protrusion having a length in said predetermined direction which is substantially equal to said length of movement, said elongate slot and said protrusion being a first elongate slot and a first projection, wherein:

one of said insulator block and said cover has a second elongate slot with said predetermined angle formed between said predetermined direction and said second elongate slot with said slot length given in said predetermined direction, and with a predetermined spacing left from one of said first elongate slot and said first protrusion that is formed in said one of said insulator block and cover;

the other of said insulator block and said cover having a second protrusion with said protrusion length in said predetermined direction, said second protrusion being movable in said second elongate slot when said cover is moved in said predetermined direction; and each of said first and said second protrusions having first and second protrusion elements with a combination of said first and said second protrusion elements given said protrusion length.

5. A connector for completing a connection from a first connector to a second connector with said first and said second connectors disposed in a predetermined direction, said first connector comprising an insulator block rigidly holding a plurality of electric contacts parallel to said predetermined direction and a cover covering said insulator block, said cover being movable in said predetermined direction by a distance equal to a length of a desired cover-to-block movement, one of said insulator block and said cover having an elongate slot which is inclined at a predetermined angle relative to said predetermined direction and a protrusion on the other of said block and said cover, said protrusion being movable in said elongate slot when said cover is moved in said predetermined direction, wherein:

said elongate slot having a slot length in said predetermined direction which is at least twice said length of movement;

said protrusion having a length in said predetermined direction which is substantially equal to said length of movement, said elongate slot and said protrusion being a first elongate slot and a first projection, wherein:

one of said insulator block and said cover has a second elongate slot with said predetermined angle formed between said predetermined direction and said second elongate slot, with said slot length given in said predetermined direction, and with a predetermined spacing left from one of said first elongate slot and said first protrusion that is formed in said one of said insulator block and cover;

the other of said insulator block and said cover having a second protrusion with said protrusion length in said predetermined direction, said second protrusion being movable in said second elongate hole when said cover is moved in said predetermined direction; and each of said first and said second protrusions being an elongate protrusion having said protrusion length.

6. A connector for completing a connection from a first connector to a second connector with said first and said second connectors disposed in a predetermined direction, said first connector comprising an insulator block rigidly holding a plurality of electric contacts parallel to said predetermined direction and a cover covering said insulator block, said cover being movable in said predetermined direction by a distance equal to a length of a desired cover-to-block movement, one of said insulator block and said cover having an elongate slot which is inclined at a predetermined angle relative to said predetermined direction and a protrusion on the other of said block and said cover, said protrusion being movable in said elongate slot when said cover is moved in said predetermined direction, wherein:

said elongate slot has a slot length in said predetermined direction which is at least twice said length of movement;

said protrusion has a length in said predetermined direction which is substantially equal to said length of movement, said elongate slot and said protrusion being a first elongate slot and a first projection, wherein:

one of said insulator block and said cover has a second elongate slot with said predetermined angle formed between said predetermined direction and said second elongate slot, with said slot length given in said predetermined direction, and with a predetermined spacing left from one of said first elongate slot and said first protrusion that is formed in said one of said insulator block and cover;

the other of said insulator block and said cover having a second protrusion with said protrusion length in said predetermined direction, said second protrusion being movable in said second elongate slot when said cover is moved in said predetermined direction;

said insulator block being movable relative to said cover with a movement perpendicular to said predetermined direction between first and second positions when said cover is moved by said length of movement to disconnect and connect said first connector from and to said second connector, wherein:

one of said insulator block and said cover comprises an urging leaf spring having an end fixed thereto;

the other of said insulator block and said cover comprising an urging member which is fixed thereto to be slidable along said urging leaf spring, having an end fixed thereto;

the other of said insulator block and said cover comprising an urging member which is fixed thereto to be slidable along said urging leaf spring, and said urging member urges said insulator block towards said first position while said insulator block is in said first position and is being moved between said first and second positions.

7. A connector as claimed in claim 6, wherein said urging member urges said insulator block towards said second position when said insulator block is put in said second position.

8. A connector as claimed in claim 6, said second connector comprising a housing for receiving said cover, wherein:

said insulator block comprises a side projection protruded therefrom perpendicular to said predetermined direction and to a direction of movement thereof between said first and said second positions;

said housing being capable of receiving said side projection and comprising an engaging member by which said side projection passes and which engages said side projection while said cover is moved into and out of said housing together with said insulator block and with said side projection and when said insulator block is put in said second positions, respectively.

9. A connector as claimed in claim 8, wherein:

said side projection has a bevelled side projection end surface directed towards said second position;

said engaging member comprising a top projection protruded towards said first position and having a bevelled top end surface directed towards said first position when said insulator block is positioned in said housing together with said side projection.

10. A connector as claimed in claim 3, wherein:

said insulator block comprises a stopper leaf spring having an end fixed thereto and a free end;

said cover comprising a stopper member establishing an engaging contact with said free end while said stopper leaf spring is left free;

said second connector comprising a pressing member for pressing said stopper leaf spring to release said engaging contact and to enable said insulator block to move relative to said cover when said first connector is connected to said second connector with said stopper leaf spring brought into contact with said pressing member.

* * * * *